US006814620B1

(12) United States Patent
Wu

(10) Patent No.: US 6,814,620 B1
(45) Date of Patent: Nov. 9, 2004

(54) ELECTRICAL CONNECTOR

(75) Inventor: Jerry Wu, Irvine, CA (US)

(73) Assignee: Hon Hai Precision Ind. Co. Ltd., Taipei Hsien (TW)

( * ) Notice: Subject to any disclaimer, the term of this patent is extended or adjusted under 35 U.S.C. 154(b) by 0 days.

(21) Appl. No.: 10/612,114

(22) Filed: Jul. 1, 2003

(51) Int. Cl.[7] ..... H01R 13/648
(52) U.S. Cl. ..... 439/608; 439/225
(58) Field of Search ..... 439/608, 579, 439/215, 225, 295, 292, 680, 681, 701, 717, 723, 607, 610, 198, 289, 291, 350, 369

(56) References Cited

U.S. PATENT DOCUMENTS 3,605,068 A * 9/1971 Rayburn ..... 439/291
5,957,714 A * 9/1999 Johnson et al. ..... 439/215
6,102,747 A 8/2000 Paagman
6,217,364 B1 4/2001 Miskin et al.

* cited by examiner

*Primary Examiner*—Alex Gilman
(74) *Attorney, Agent, or Firm*—Wei Te Chung

(57) ABSTRACT

An electrical connector (1) includes a dielectric housing (2) including front and rear housing portions (20, 22) each defining a number of juxtaposed channels (202) along a first direction and an intermediate housing portion (24) interconnecting the front housing portion with the rear housing portion. A number of circuit modules (3) are side by side retained in the housing along a second direction perpendicular to the first direction. Each circuit module includes a first circuit board (30), a second circuit board (32) and a number of cables (33) electrically connecting the first circuit board with the second circuit board. The first and the second circuit boards have front and rear mating edges (30, 32) respectively received in the channels of the front and the rear housing portions for mating with complementary components.

13 Claims, 4 Drawing Sheets

ELECTRICAL CONNECTOR

CROSS-REFERENCE TO RELATED APPLICATIONS

Relevant subject matter is disclosed in a co-pending U.S. Patent application with an unknown serial number filed on Jun. 18, 2003, and entitled "ELECTRICAL CONNECTOR HAVING LONG CIRCUIT BOARDS", and U.S. patent application Ser. Nos. 10/278,520 filed on Oct. 22, 2002 and entitled "ELECTRICAL CABLE CONNECTOR", 10/316,547 filed on Dec. 10, 2002 and entitled "CABLE ASSEMBY" and 10/317,830 filed on Dec. 11, 2002 and entitled "CABLE ASSEMBLY", all of which are invented by the same inventor as this patent application and assigned to the same assignee with this application.

BACKGROUND OF THE INVENTION

1. Field of the Invention

The present invention relates to an electrical connector for high speed signal transmission, and particularly to an electrical connector for simultaneously engaging with two complementary connectors respectively mounted on first and second circuit substrates to establish an electrical connection therebetween.

2. Description of Related Art

With the development of communication and computer technology, high density electrical connectors are desired to construct a large number of signal transmitting paths between two electronic devices. Each of these electrical connectors provides a plurality of circuit boards to thereby achieve improved signal transmission of different electrical characteristics through the connector. Such high density electrical connectors are widely used in internal connecting systems of severs, routers and the like requiring high speed data processing and communication.

These connectors generally comprise two mating connector halves, i.e., a plug connector connecting with a first circuit substrate and a receptacle connector connecting with a second circuit substrate. An electrical connection is established between the first and the second circuit substrates through a direct engagement of the plug and the receptacle connectors. In some special circumstances where the connectors mounted on the first and the second circuit substrates are of the same type or the first and the second circuit substrates are required to have a larger distance therebetween, cable assemblies are then provided to achieve the electrical connection between the first and the second circuit substrates.

U.S. Pat. No. 6,217,364, issued to Miskin et al., discloses a cable assembly comprising a cable and an electrical connector terminated to one end of the cable. The connector includes an insulating housing formed by a pair of substantially identical housing halves and conductive terminals overmolded in a plurality of thin flat wafers to connect with a plurality of wires of the cable. The housing halves combines to define an interior cavity having a front opening and a rear opening. The wafers are closely juxtaposed in a parallel array and are positioned within the interior cavity of one of the housing halves such that the cable projects out of the rear opening of the cavity. The other housing half is then to completely enclose the cable and wafer subassembly. However, the cable and wafer subassembly are retained in the housing by securing the housing halves together through bolts and nuts, thereby complicating the assembly of the cable assembly. Furthermore, an engagement of the housing halves is easy to become loose due to vibration during the transportation and other matters, whereby the cable and the wafer subassembly cannot be stably retained in the housing.

U.S. Pat. No. 6,102,747 (the '747 patent), issued to Paagman, discloses a cable assembly comprising a cable and an electrical connector terminated to one end of the cable. Referring to FIGS. 4a–4c and 5a–5c of the '747 patent, the connector includes an insulating housing with a plurality of parallel slots defined therein and a plurality of modules received in the slots of the housing. Each module includes a circuit substrate, a receptacle carrier having a plurality of fork contacts at one end of the substrate and an insulation displacement contact (IDC) carrier at the other end of the substrate opposite the terminal carrier. The insulation displacement carrier has insulation displacement contacts connecting with conductors of corresponding cables. The modules are retained in the housing through an interference fit with the housing.

In order to electrically connect the first and the second circuit substrates, the cable assembly is required to have two connectors terminated to each end of the cable by connecting means as disclosed in the above-mentioned patents, thereby complicating the manufacture of the cable assembly. As a result, the manufacturing cost is accordingly increased.

Hence, an improved electrical connector for electrically connecting a first circuit substrate to a second circuit substrate is required to overcome the disadvantages of the related art.

SUMMARY OF THE INVENTION

Accordingly, an object of the present invention is to provide an electrical connector which can simultaneously engage with two complementary connectors respectively mounted on first and second circuit substrates to achieve an electrical connection therebetween.

In order to achieve the object set forth, an electrical connector in accordance with the present invention comprises a dielectric housing including front and rear housing portions each defining a plurality of juxtaposed channels along a first direction and an intermediate housing portion interconnecting the front housing portion with the rear housing portion. A plurality of circuit modules is side by side retained in the housing along a second direction perpendicular to the first direction. Each circuit module includes a first circuit board, a second circuit board and a plurality of cables electrically connecting the first circuit board with the second circuit board. The first and the second circuit boards have front and rear mating edges respectively received in the channels of the front and the rear housing portions for mating with complementary components.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
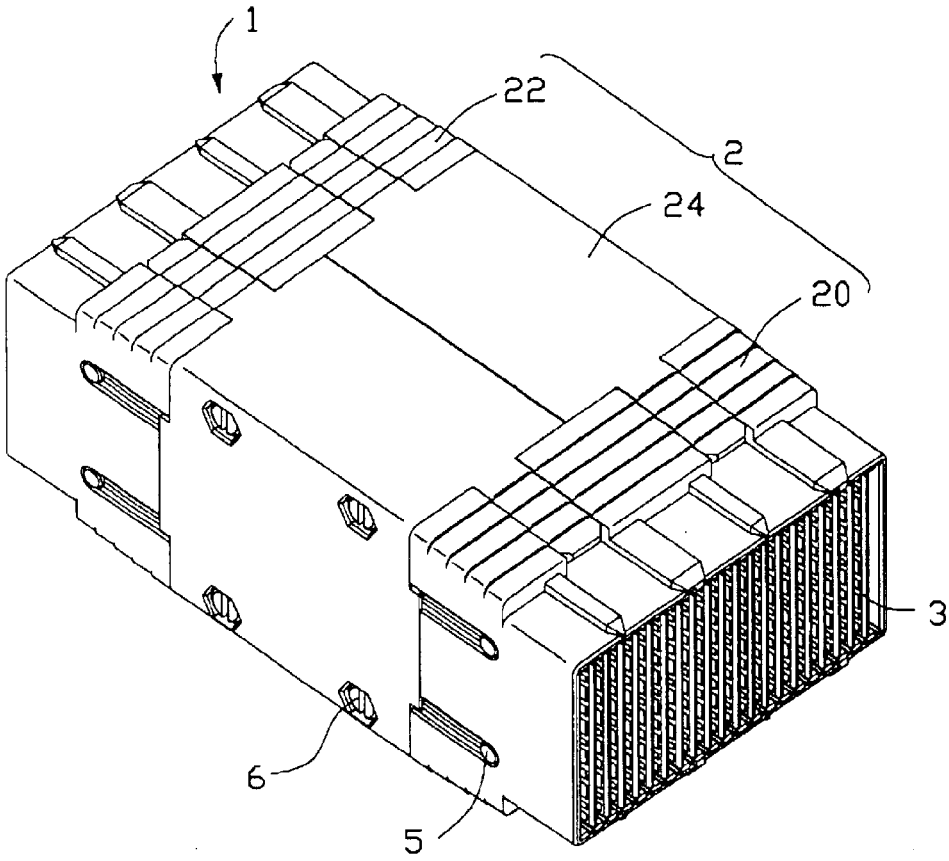
FIG. 1 is an assembled perspective view of an electrical connector in accordance with the present invention.
Figure 2:
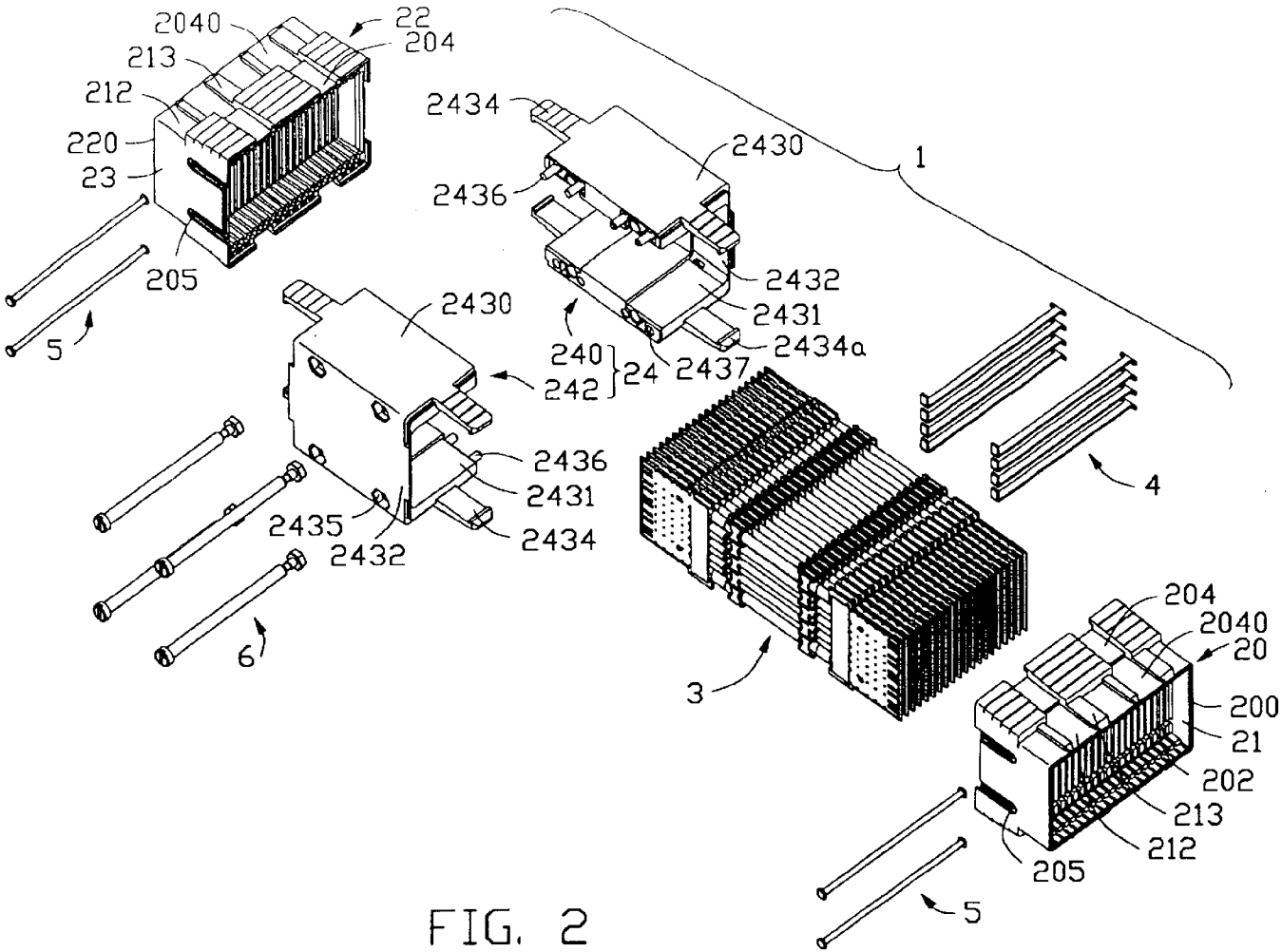
FIG. 2 is an exploded perspective view of the connector shown in FIG. 1.

Referring to FIGS. 1 and 2, an electrical connector 1 in accordance with the present invention comprises an elongate dielectric housing 2, a plurality of circuit modules 3 received in the dielectric housing 2, a plurality of first fastening elements 4 for locking the circuit modules 3 together, and a plurality of second and third fastening elements 5, 6 for retaining the circuit modules 3 in the housing 2.

The dielectric housing 2 comprises a front housing portion 20, a rear housing portion 22 and an intermediate housing portion 24 interconnecting the front housing portion 20 with the rear housing portion 22. The front and the rear housing portions 20, 22 are identical in structure and each are generally in a rectangular shape. The front and the rear housing portions 20, 22 have front and rear mating sections 21, 23 adjacent front and rear mating faces 200, 220 thereof, respectively. Each of the front and the rear mating sections 21, 23 is formed with a plurality of protrusions 213 at a top face 212 thereof for ensuring a blind mate with a complementary connector (not shown). The front and the rear housing portions 20, 22 each define a plurality of juxtaposed channels 202 extending into the front and the rear mating sections 21, 23 along a front-to-back direction. The front and the rear housing portions 20, 22 further define a plurality of recesses 204 in top and bottom faces, a plurality of cavities 2040 recessed inwardly from the corresponding recesses 204 and a plurality of apertures 205 extending through opposite side faces along a lateral direction substantially perpendicular to the extending direction of the channels 202.

The intermediate housing portion 24 comprises a split body having a first half 240 and a second half 242. Each half 240, 242 includes a top panel 2430, a bottom panel 2431 and a side panel 2432 formed between the top panel 2430 and the bottom panel 2431. A plurality of latches 2434 extends forwardly and rearwardly from front and rear edges of the top and the bottom panels 2430, 2431. Each latch 2434 has a projection 2434*a* formed at a free end thereof. The first and the second halves 240, 242 define a plurality of bores 2435 in the top and the bottom panels 2430, 2431 penetrating through the side panels 2432. The first half 240 and the second half 242 have a plurality of dowel pins 2436 and corresponding holes 2437 for joining the first half 240 and the second half 242 together. It should be noted that any other suitable connecting means may be employed to connect the first and the second halves 240, 242. This split design of the intermediate housing portion 24 helps to facilitate connecting the front and the rear housing portions 20, 22. It can be understood that the intermediate housing portion 24 can also be made as a one-piece configuration.

Figure 3:
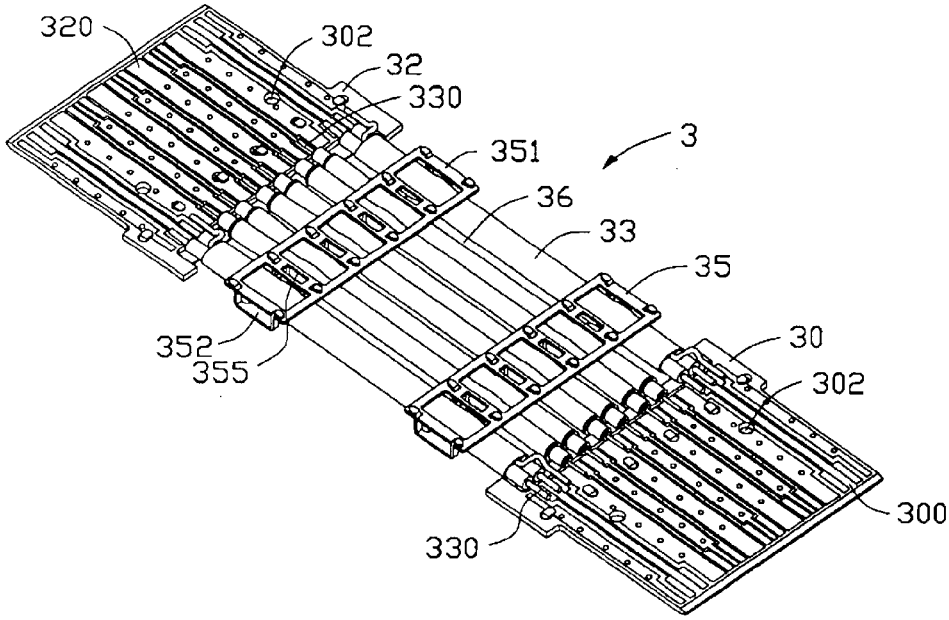
FIG. 3 is an enlarged perspective view of a circuit module of the connector.
Figure 4:
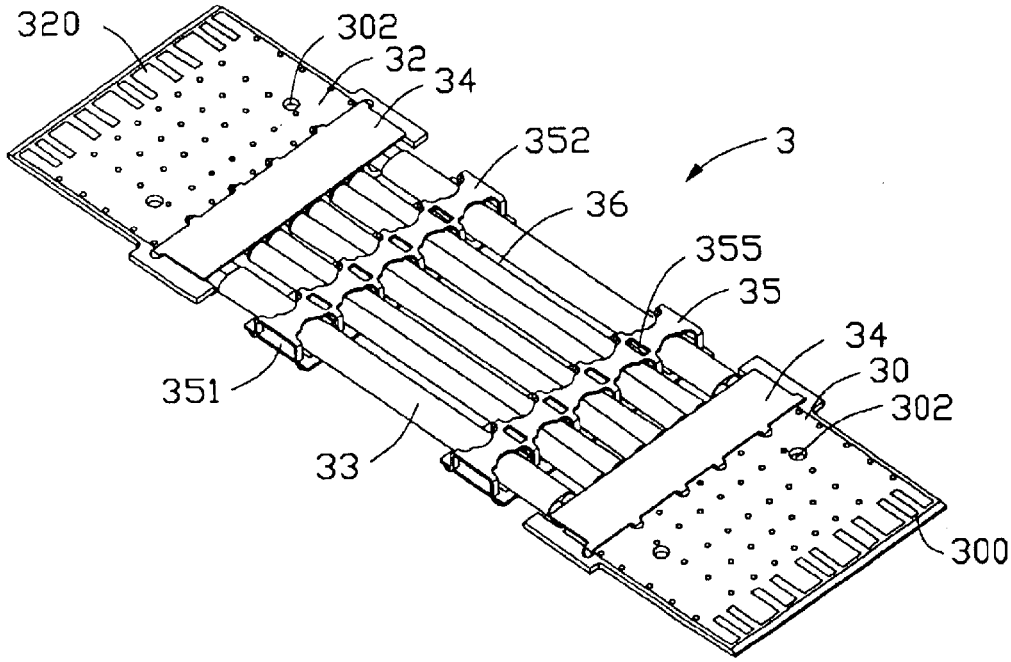
FIG. 4 is a view similar to FIG. 3 but taken from a different perspective.

Each one of the circuit modules 3 is identical in structure and an exemplary one thereof is shown in FIGS. 3 and 4. Each circuit module 3 comprises a first circuit board 30, a second circuit board 32 and a plurality of cables 33 electrically connecting the first circuit board 30 with the second circuit board 32. The first and the second circuit boards 30, 32 are identical in structure and each includes a dielectric substrate made of conventional circuit board substrate material, such as FR4, a plurality of conductive signal traces (not labeled) on one side of the substrate for providing electrical paths through the connector 1 and a plurality of grounding traces (not labeled) on both sides of the substrate for grounding purpose. The first and the second circuit boards 30, 32 comprise opposite front and rear mating edges 300, 320 respectively received in the channels 202 of the front and the rear mating sections 21, 23 of the housing 2. The first and the second circuit boards 30, 32 define a plurality of through holes 302 aligned with corresponding apertures 205 of the front and the rear housing portions 20, 22. The cables 33 of each circuit module 3 are arranged in a common plane and have conductive cores 330 at opposite ends soldered to the signal traces on the first and the second circuit boards 30, 32, respectively. Thus, electrical paths are constructed between the first and the second circuit boards 30, 32 via the cables 33.

The circuit module 3 further comprises a pair of grounding plates 34 and a pair of cable clamps 35 for being applied to the cables 33. The pair of grounding plates 34 are preferably copper tapes and are respectively disposed on the first and the second circuit boards 30, 32 for providing electromagnetic interference (EMI) shielding function to the conductive cores 330.

Each cable clamp 35 includes a first tape 351 and a second tape 352 both are stamped and formed from metal tapes. The first and the second tapes 351, 352 are interlocked with each other and clamp the cables 33 from opposite sides. The first and the second tapes 351, 352 further define a plurality of through holes 355 aligned with corresponding gaps 36 between adjacent cables 33.

In assembly, the circuit modules 3 are moved toward the front mating face 200 of the front housing portion 20 until the first circuit boards 30 arrive at a position in which the front mating edges 300 are received in the channels 202 of the front housing portion 20. The first fastening elements 4 are inserted through the through holes 355 of the cable clamps 35 for locking the circuit modules 3 together for strain relief purpose. The second fastening elements 5 are inserted through the apertures 205 of the front housing portion 20 and the through holes 302 adjacent the front edges 300 of the first circuit boards 30. The second fastening elements 5 are further fastened to the front housing portion 20 for keeping the first circuit boards 30 in the front housing portion 20.

The first and the second halves 240, 242 of the intermediate housing portion 24 are first assembled toward each other in the lateral direction by an interferential engagement between the dowel pins 2436 and the corresponding holes 2437, and then are successively commonly attached to the front housing portion 20 along the front-to-back direction with the projections 2434*a* of the latches 2434 mechanically engaging the cavities 2040 of the recesses 204 of the front housing portion 20. The third fastening elements 6 are inserted through the bores 2435 of the intermediate housing portion 24 to restrain movement of the circuit modules 3 in a vertical direction.

The rear mating edges 320 of the second circuit boards 32 are exposed outside the front housing portion 20 and the intermediate housing portion 24 and are moved toward the rear mating face 220 of the rear housing portion 22 until the rear mating edges 320 are received in the channels 202 of the rear housing portion 22. The projections 2434*a* of the latches 2434 of the intermediate housing portion 24 mechanically engage the cavities 2040 of the recesses 204 of the rear housing portion 22. The second fastening elements 5 are inserted through the apertures 205 of the rear housing portion 22 and the through holes 302 adjacent the rear mating edges 320 of the second circuit boards 32. The second fastening elements 5 are further fastened to the rear housing portion 22 for keeping the second circuit boards 32 in the rear housing portion 22.

It is noted that the first and the second circuit boards 30, 32 are electrically connected with each other via the cables 33 and have the front and the rear mating edges 300, 320 respectively received in the front and the rear housing portions 20, 22 for simultaneously mating with two complementary connectors respectively mounted on first and second circuit substrates (not shown) to thereby establish an electrical connection therebetween. It can be understood that the dielectric housing 2 can be made as a one-piece configuration and the first and the second circuit boards 30, 31 can be electrically connected with each other by other means, such as conductors.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a dielectric housing comprising opposite first and second mating sections, the housing defining a plurality of juxtaposed channels in the first and the second mating sections, the channels being arranged along a first direction of the housing; and a plurality of circuit modules retained in the housing, each circuit module comprising a first circuit board, a second circuit board, and a plurality of cables electrically connecting the first circuit board with the second circuit board, the first and the second circuit boards being respectively side by side received in the channels of the first and the second mating sections and extending along a second direction perpendicular to the first direction, the first and the second circuit boards comprising first and second mating edges respectively received in the first and the second mating sections of the housing for mating with complementary components.

2. The electrical connector as claimed in claim 1, wherein each of the first and the second mating sections comprises a plurality of protrusions at a top face thereof for ensuring a blind mate with a corresponding complementary component.

3. The electrical connector as claimed in claim 1, wherein the cables comprise exposed conductive cores at opposite ends thereof electrically soldered to the first and the second circuit boards.

4. The electrical connector as claimed in claim 1, wherein each circuit module comprises a pair of grounding plates respectively disposed on the first and the second circuit boards for electromagnetic interference (EMI) protection of the cables.

5. The electrical connector as claimed in claim 4, wherein each circuit module comprises a cable clamp bonding the cables together.

6. The electrical connector as claimed in claim 5, further comprising a first fastening element, and wherein each cable clamp defines at least one through hole, and the first fastening element is inserted through the through holes of the cable clamps for locking the circuit modules together.

7. The electrical connector as claimed in claim 1, wherein the dielectric housing comprises front and rear housing portions respectively receiving therein the first and the second mating edges of the first and the second circuit boards.

8. The electrical connector as claimed in claim 7, wherein the front and the rear housing portions are identical in structure.

9. The electrical connector as claimed in claim 7, further comprising a plurality of second fastening elements, and wherein the front and the rear housing portions define a plurality of apertures extending in the first direction, and the first and the second circuit boards define a plurality of through holes aligned with corresponding apertures, the second fastening elements inserting through corresponding apertures of the housing portions and corresponding through holes of the first and the second circuit boards.

10. The electrical connector as claimed in claim 7, wherein the housing comprises an intermediate housing portion interconnecting the front and the rear housing portions.

11. The electrical connector as claimed in claim 10, further comprising a third fastening element, and wherein the intermediate housing portion defines a bore extending in the first direction, the second fastening element inserting through the bore.

12. The electrical connector as claimed in claim 10, wherein the intermediate housing portion comprises first and second halves joined together.

13. The electrical connector as claimed in claim 12, wherein each of the first and the second halves of the intermediate housing portion comprises a plurality of latches, and the front and the rear housing portions define a plurality of recesses fittingly receiving the latches.

* * * * *